US006360855B1

(12) United States Patent
Szu-Yin

(10) Patent No.: US 6,360,855 B1
(45) Date of Patent: Mar. 26, 2002

(54) WHEEL FOR A STATIONARY BICYCLE

(76) Inventor: Cheng Szu-Yin, 4F, No. 357, Da-Na Road, Si-Lin, Taipei City (TW)

( * ) Notice: Subject to any disclaimer, the term of this patent is extended or adjusted under 35 U.S.C. 154(b) by 0 days.

(21) Appl. No.: 09/439,451

(22) Filed: Nov. 15, 1999

(51) Int. Cl.[7] ..... B60L 7/00

(52) U.S. Cl. ..... 188/161; 188/164; 188/267; 482/63

(58) Field of Search ..... 188/161, 163, 188/164, 158, 159, 160, 267; 192/84.5; 242/288; 482/5, 6, 57, 63, 92, 903

(56) References Cited

U.S. PATENT DOCUMENTS 5,072,930 A * 12/1991 Sun ..... 272/73
5,236,069 A * 8/1993 Peng ..... 188/267
5,437,353 A * 8/1995 Wu ..... 188/164
5,586,624 A * 12/1996 Ko et al. ..... 188/164
5,711,404 A * 1/1998 Lee ..... 188/164

* cited by examiner

*Primary Examiner*—Pam Rodriguez
(74) *Attorney, Agent, or Firm*—Charles E. Baxley

(57) ABSTRACT

A wheel for a stationary bicycle includes a first disk and a second disk with an axle extending through the two disks. A plurality of rods and rollers are connected between the two disks so as to obtain a gap between the two disks. Two plates are respectively pivotally connected between the two disks at one end thereof and the other end of each plate is connected by a wire which extends through one of the disks. The axle is located between the two plates. Each plate has a plurality of magnets connected thereon so that when pulling the wire, the magnets together with the plates are moved relative to a periphery of the disks and this changes a distance between the magnets and a magnetic field damping device of the stationary bicycle.

5 Claims, 3 Drawing Sheets

WHEEL FOR A STATIONARY BICYCLE

FIELD OF THE INVENTION

The present invention relates to a structure for a wheel, and more particularly, to a wheel of a stationary bicycle and the wheel having two pivotable plates on which magnets are connected so that when pulling braking wire of the stationary bicycle the plates and the magnets on the plates are moved relative to a magnetic field damping device.

BACKGROUND OF THE INVENTION

A conventional stationary bicycle 100 as shown in FIG. 1 has a frame with a seat tube on which a set 1 is connected, a crank 12, a first wheel 13 is co-axially connected to the crank 12, and a second wheel 15 which is connected to the first wheel 13 by a chain 14. A user may sit on the seat 1 and rotates the crank 12 by his/her feet stepping on the pedals 120 to rotate the second wheel 15. In order to increase the exercising feature of the stationary bicycle, a damping device is cooperated with the wheel so as to increase the resistant force while the wheel is rotated by the user. The damping device includes a magnetic field damping device 18 and the second wheel 15 is co-axially connected to a free-fly wheel 27 and an Aluminum wheel 16. When rotating the crank, the distance between the Aluminum wheel 16 and the magnetic field damping device 18 will generate different damping force applied to the Aluminum wheel 16 so as to achieve different exercising purposes.

FIG. 2 shows an improved Aluminum wheel 20 known to applicant wherein the body of the wheel 20 is made of cast iron and a plurality of notches are defined in a periphery of the wheel 20. A ring-shaped Aluminum 300 is mounted to the wheel 20 and includes a plurality of protrusions 320 which fill in the notches so as to reduce the quantity of Aluminum and therefore reduces the manufacturing cost.

The present invention intends to provide a wheel that is used in a stationary bicycle that involves a magnetic field damping device. The wheel includes two plates eccentrically and respectively connected to an inside of the wheel and each plate has magnets connected thereto. A wire is connected to the plates so that when pulling the plates, the curvature of the plates is changed and the distance between the magnets and the magnetic field damping device is adjusted to generate different levels of damping force.

SUMMARY OF THE INVENTION

In accordance with one aspect of the present invention, there is provided a wheel for a stationary bicycle having a magnetic field damping device. The wheel comprises a first disk having a plurality of rods and first protrusion extending from a side of the first disk. A second disk has a plurality of second protrusion extending from aside of the second disk so that a plurality of rollers are connected between the first protrusion and the second protrusion that are in alignment with each other. A first plate has a first end thereof pivotably connected at a first point between the first disk and the second disk. A plurality of magnets are connected to the first plate. A second plate has a first end thereof pivotably connected at a second point between the first disk and the second disk. A plurality of magnets are connected to the first plate. A wire is connected to a second end of the first plate and a second end of the second plate.

The object of the present invention is to provide wheel structure that has a simple structure and movable magnets which are moved by pulling a wire so as to adjust the distance between the magnets and a magnetic field damping device.

There and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 2:
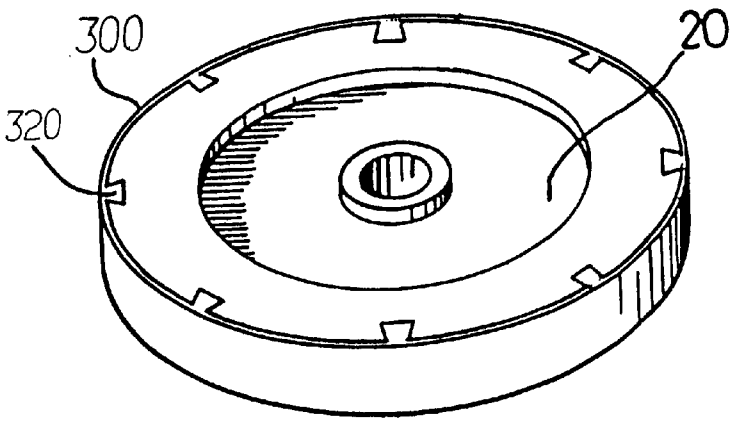
FIG. 2 PRIOR ART
FIG. 2 is a perspective view to show a conventional wheel used in a stationary bicycle.
Figure 1:
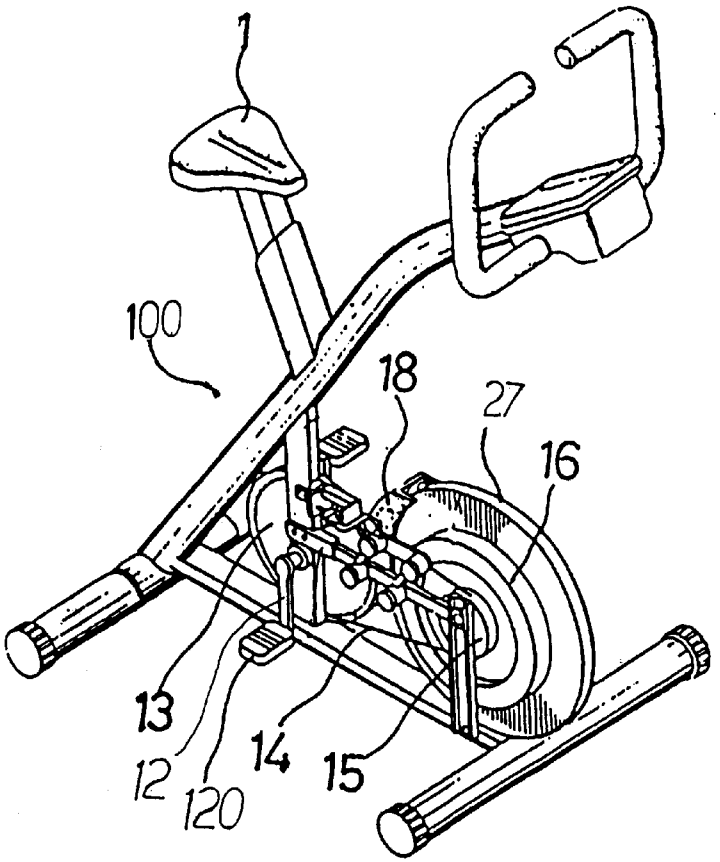
FIG. 1 PRIOR ART
FIG. 1 is a perspective view to show a conventional stationary bicycle equipped with a magnetic field damping device and an aluminum wheel.
Figure 3:
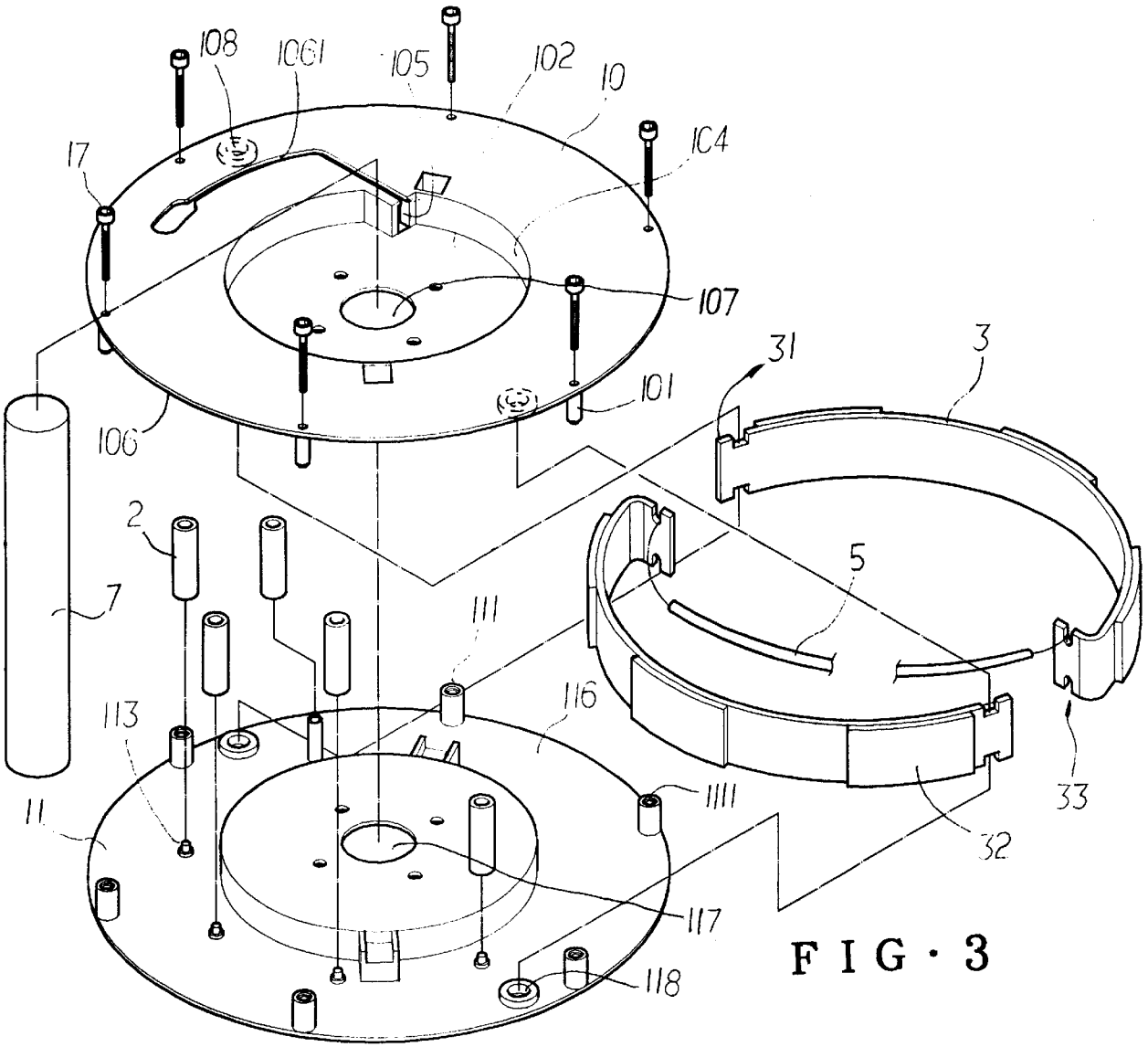
FIG. 3 is an exploded view to show a wheel in accordance with the present invention.
Figure 4:
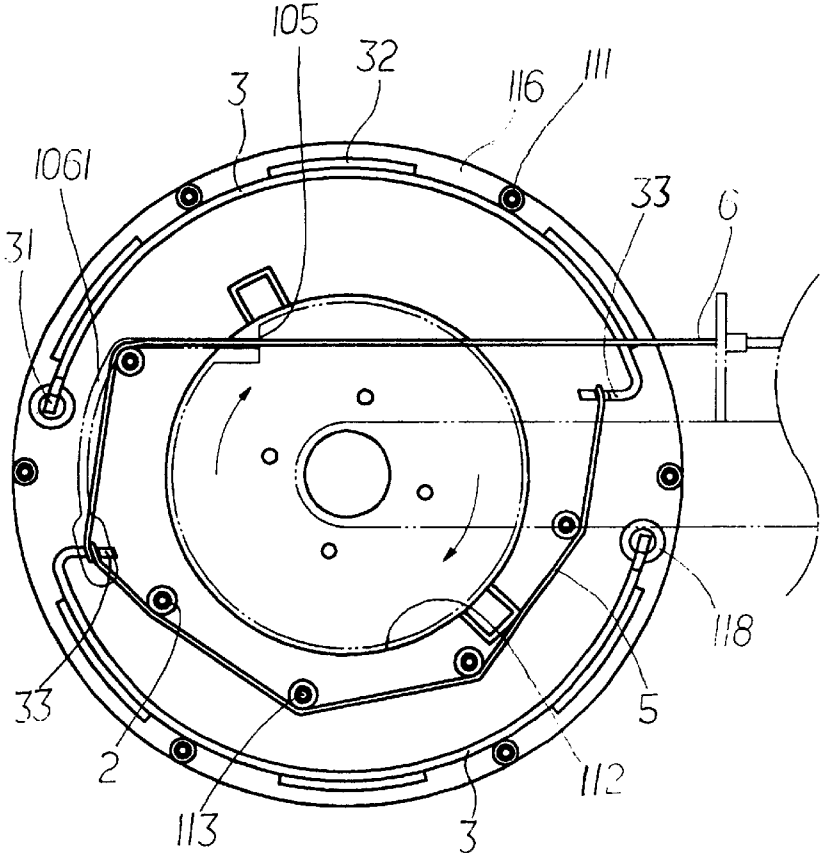
FIG. 4 is an illustrative view to show the arrangement of the plates and the wire of the wheel of the present invention.

Referring to FIGS. 3 and 4, the wheel in accordance with the present invention comprises a first disk 10 having a recess portion 102 defined therein and a first central hole 107 is defined through a bottom defining the recess portion 102. A hole 105 is defined through peripheral wall 104 defining the recess portion 102 and a slot 1061 is defined through the first disk 10 so that a wire 6 extends through the hole 105 and the slot 1061. A plurality of rods 101 and first protrusions 103 extend from a side 106 of the first disk 10. Two rings 108 are connected on the side 106 of the first plate 10.

A second disk 11 has a second central hole 117 so that an axle 7 is engaged with the first central hole 107 and the second central hole 117. A plurality of sockets 111 and second protrusions 113 extend from a side 116 of the second disk 11 wherein each socket 111 has a threaded inner periphery 1111 so that a bolt 17 extends through the rod 101 of the first disk 10 and engages with the sockets 111 on the second disk 11.

A plurality of rollers 2 are connected between the first protrusion 103 and the second protrusion 113 in alignment with each other, the rods 101 contacting the side 116 of the second disk 11 so as to obtain a gap between the first disk 10 and the second disk 11. Two rings 118 are connected on the side 116 of the second plate 11.

A first plate 3 has a first end 31 thereof pivotably connecting at a first point, the pair of aligned rings 108, 118, between the first disk 10 and the second disk 11. A plurality of magnets 32 are connected to the first plate 3. A second plate 30 has a first end 31 thereof pivotably connecting at a second point, the other pair of aligned rings 108, 118, between the first disk 10 and the second disk 11. A plurality of magnets 32 are connected to the first plate 3. A rope 5 is tied with the notches 33 of the first plate 3 and goes around the rollers 2 and tied with the notches 33 of the second plate 30. The wire 6 is then connected to the rope 5 as shown in FIG. 4. The two plates 3, 30 are arranged to respectively contact the sockets 111 and the rod 101.

Figure 5:
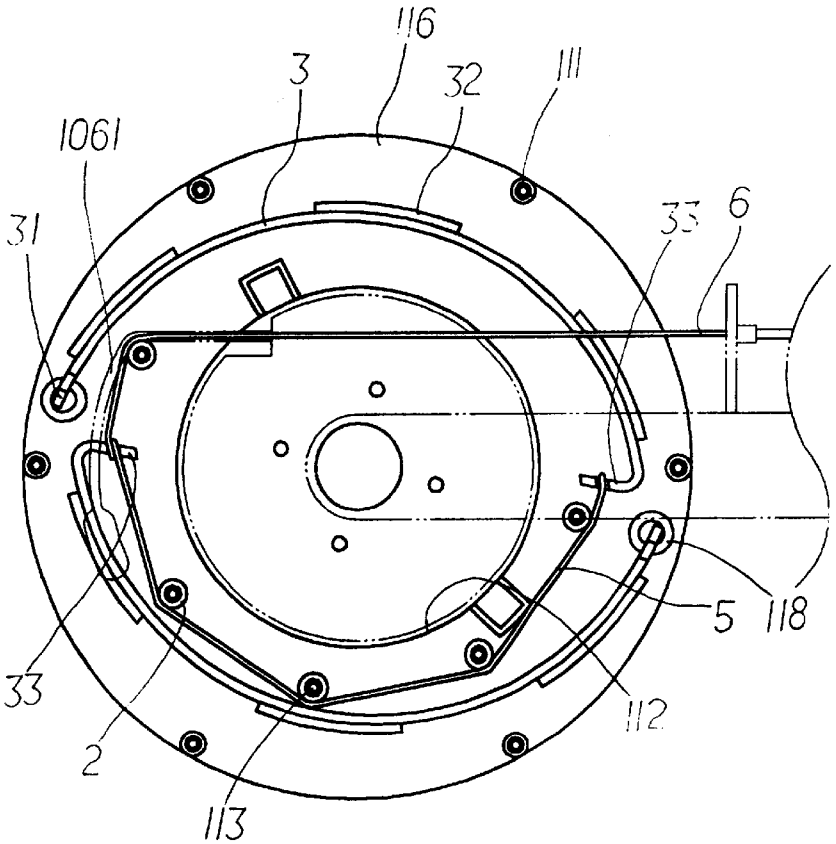
FIG. 5 is an illustrative view to show when the wire is pulled, the plates are bent and the magnets are moved.

As shown in FIG. 5, when pulling the wire 6, the second end of the two plates 3, 30 are bend and therefore removes the magnets 32 on the two plates 3, 30 away from the sockets 111. In other words, the pull of the wire 6 adjusts the distance between the magnets 32 and a magnetic field damping device of the stationary bicycle (not shown).

Then wheel of the present invention has simple structure and the manufacturing cost is lowered.

While we have shown and described various embodiments in accordance with the present invention, it should be clear to those skilled in the art that further embodiments may be made without departing from the scope and spirit of the present invention.

What is claimed is:

1. A wheel for a stationary bicycle having a magnetic field damping device comprising:

a first disk having a first central hole defined therethrough, a plurality of rods and first protrusions extending from a side of said first disk;

a second disk having a second central hole defined therethrough and a plurality of second protrusions extending from a side of said second disk, a plurality of rollers connected between said first protrusions and said second protrusions in alignment with each other, an axle engaged with said first central hole and said second, central hole, said rods contacting said side of said second disk so as to obtain a gap between said first disk and said second disk;

a first plate having a first end thereof pivotably connected at a first point between said first disk and said second disk, a plurality of magnets connected to said first plate, a second plate having a first end thereof pivotably connected at a second point between said first disk and said second disk; and a wire connected to a second end of said first plate and a second end of said second plate.

2. The wheel as claimed in claim 1, wherein said second end of said first plate and said second end of said second plate each have a notch so that said wire to engaged with said notches in said first plate and said second plate.

3. The wheel as claimed in claim 1 further comprising two rings connected on said side of said first disk and two rings connected on said side of said second disk, said first end of said first plate and said first end of said second plate respectively and pivotably engaged between aligned rings on said first disk and said second disk.

4. The wheel as claimed in claim 1, said first disk has a recess portion defined therein and a hole defined through a peripheral wall defining said recess portion so that said wire extends through said hole.

5. The wheel as claimed in claim 1 further comprising a plurality of sockets extending from said side of said second disk, each socket having threaded inner periphery so that a bolt extends through one of said rods of said first disk and is engaged with one of said sockets on said second disk.

* * * * *